US005365684A

United States Patent [19]

Cartmell

[11] Patent Number: 5,365,684

[45] Date of Patent: Nov. 22, 1994

[54] METHOD OF CONSTRUCTING AN ORIGAMI-STYLE OF FOLDABLE PICTURE FRAME FROM A UNITARY BLANK OF SHEET MATERIAL

[76] Inventor: Brian Cartmell, 10338-137 Street, Edmonton, Alberta, Canada, T5N 2H2

[21] Appl. No.: 112,134

[22] Filed: Aug. 26, 1993

[51] Int. Cl.[5] ..... G09F 1/12

[52] U.S. Cl. ..... 40/155; 206/45.14; 493/356

[58] Field of Search ..... 40/154, 155, 124.1, 40/539, 152, 152.1; 229/169, 165, 167; 206/45.14; 493/355, 356, 944, 952

[56] References Cited

U.S. PATENT DOCUMENTS

| | | | |
|---|---|---|---|
| 723,696 | 3/1903 | Maine | 40/154 |
| 796,310 | 8/1905 | Fisher | 40/154 |
| 1,421,448 | 7/1922 | Fritz | 40/154 |
| 1,787,498 | 1/1931 | Tinsley | 229/167 X |
| 2,321,145 | 6/1943 | Jones | 229/167 X |
| 2,435,135 | 1/1948 | Franck | 229/165 X |
| 2,681,174 | 6/1954 | Bergstein | 229/169 X |
| 4,782,611 | 11/1993 | Papov | 40/154 |
| 4,819,354 | 4/1989 | Papov | 40/154 |
| 4,885,854 | 12/1989 | Brandes | 40/152.1 |

FOREIGN PATENT DOCUMENTS

| | | |
|---|---|---|
| 2637455 | 3/1977 | Germany . |
| 3940770 | 4/1991 | Germany . |
| 1401844 | 7/1975 | United Kingdom . |
| 2104378 | 3/1983 | United Kingdom . |
| 2220854 | 1/1990 | United Kingdom . |
| WO88/09635 | 12/1988 | WIPO . |

*Primary Examiner*—Kenneth J. Dorner
*Assistant Examiner*—Joanne Silbermann
*Attorney, Agent, or Firm*—Anthony R. Lambert

[57] ABSTRACT

A method of constructing an origami-style of foldable picture frame is described. Firstly, a unitary blank of sheet material is cut to a described shape. Secondly, a series of cut lines necessary to form a picture viewing window are placed on the unitary blank. Thirdly, trim off corners enabling opposed edges of a portion of the unitary blank to inserted into the picture viewing window. Fourthly, place a series of fold lines are placed on a portion of the unitary blank to form a primary panel. Fifthly, a series of fold lines are placed on a portion of the unitary blank to form a secondary panel adapted to overlay the primary panel. Sixthly, a series of fold lines are placed adjacent the cut lines where the picture viewing window is to be positioned. Seventhly, a series of fold lines are placed on a foldable portion adapted to be inserted into the picture viewing window. Eighthly, a series of fold lines are placed on another foldable portion adapted to be inserted into the picture viewing window. Ninthly, the unitary blank of sheet material is folded along the described fold lines to form a picture frame.

8 Claims, 7 Drawing Sheets

METHOD OF CONSTRUCTING AN ORIGAMI-STYLE OF FOLDABLE PICTURE FRAME FROM A UNITARY BLANK OF SHEET MATERIAL

BACKGROUND OF THE INVENTION

There are a wide variety of known methods of constructing an origami-style of foldable picture frame disclosed in the prior art. The picture frames produced by following the teachings of these methods are judged by comparing their relative strength and aesthetic appearance. The efficacy of these methods are judged by comparing their relative ease of assembly, and relative ability to remain in the folded position.

In order to maintain the picture frame in the folded position, a number of the methods require that parts of the frame be permanently affixed together. An example of such a method is U.S. Pat. No. 4,819,354 which was granted to Papov in 1989. This reference calls for a number of back pieces to be by adhered by suitable means, such as sticky tape, glue or adhesive. Another example of such a method is United Kingdom Patent Application 2,104,378 which was filed by Lewis in 1981 and published in 1983. This teaching adversely affects the frame being taken apart and subsequently reused. Other methods call for the use of attachment tabs. Attachment tabs facilitate reusability, but are prone to loss of a tab if care is not taken. An example of a method employing tabs which are inserted into slots is United Kingdom Application 2,220,854 filed by Creeper, Creighton, and Fellows in 1988 and published in 1990.

SUMMARY OF THE INVENTION

What is required is a method of constructing an origami-style of foldable picture frame from a unitary blank of sheet material that is reusable, easy to assembly, retains its folded position without requiring gluing or attachment tabs, and produces a strong and aesthetically attractive picture frame.

According to the present invention there is provided a method of constructing an origami-style of foldable picture frame from a unitary blank of sheet material including the following described steps. Firstly, cut a unitary blank of sheet material to form a substantially rectangular head portion and a substantially rectangular depending neck portion. The unitary blank has a first edge, a second edge, a third edge, a fourth edge, and an abbreviated fifth edge. The first edge defines an extremity of the neck portion. The fourth edge defines an extremity of the head portion. The fifth edge is that portion of the head portion which extends beyond the neck portion. Secondly, place a series of cut lines on the unitary blank. A first cut line is spaced from the second edge on the neck portion of the unitary blank defining a desired width for a picture viewing window. A second cut line is spaced from the third edge of the neck portion in parallel spaced relation to the first cut line. The second cut line is the same length as the first cut line. The spacing between the first cut line and the second cut line define a desired length for the picture viewing window. A third cut line extends transversely between the first cut line and the second cut line in an intermediate position. Thirdly, trim off corners formed on the head portion of the unitary blank where the fifth edge meets the second edge and the third edge and where the fourth edge meets the second edge and the third edge, such that the width dimension of the second edge and the third edge are less than the length of the first cut line and the second cut line enabling the second edge and the third edge of the head portion to be adapted for insertion into the picture viewing window. Fourthly, form a substantially rectangular primary panel on the head portion by placing a first fold line spaced from the first edge, a second fold line spaced from the second edge, a third fold line spaced from the third edge and opposed to the second fold line, such that the fourth edge of the unitary blank is opposed to the first fold line and completes the primary panel. The primary panel has a top face. Fifthly, form material extending from the first fold line to the first edge into a first foldable portion by placing a series of three fold lines parallel to the first fold line thereby dividing the first portion into a first exterior thickness section, a substantially rectangular secondary panel substantially the same size as the primary panel and adapted to overlay the primary panel, a second exterior thickness section, and a retaining flap. The secondary panel has peripheral border sections defined by the cut lines for the picture viewing window and a first transverse fold line spaced from the first edge and extending between the first cut line and the second cut line, and a second transverse fold line extending between the first cut line and the second cut line opposed to the first transverse fold line. Sixthly, form material extending inwardly from the first transverse fold line to the third cut line and the second transverse fold line to the third cut line into interior foldable portions by placing a series of at least two fold lines parallel to the transverse fold line thereby dividing the interior portions into a thickness section and a retaining flap. Seventhly, form material extending from the second fold line to the second edge into a second foldable portion by placing a series of three fold lines parallel to the second fold line thereby dividing the second portion into an exterior thickness section, a border section, an interior thickness section, and retaining flap. Eighthly, form material extending from the third fold line to the third edge into a third foldable portion by placing a series of three fold lines parallel to the third fold line thereby dividing the third portion into an exterior thickness section, a border section, an interior thickness section, and retaining flap. The thickness sections of each of the foldable portions being of uniform dimension and the border sections of each of the foldable portions being of uniform dimension. Ninthly, folding the unitary blank of sheet material to form a picture frame by making the following described folds. Fold the first foldable portion such that the secondary panel overlies the front face of the primary panel with the retaining flap resting parallel to the primary panel. Fold the interior foldable portions such that the retaining flap rests parallel to the primary panel. Fold the second foldable portion such that the interior thickness section and the retaining flap section extend through the picture viewing window with the retaining flap section inserted between the secondary panel and the primary panel. Fold the third foldable portion such that the interior thickness section and the retaining flap section extend through the picture viewing window with the retaining flap section inserted between the secondary panel and the primary panel.

The first through eighth steps of the described method can be completed at the factory. By producing a unitary blank which is precut and has fold lines clearly marked, members of the public can take the unitary blank and complete the final step to produce a picture frame. This is a comparatively simple assembly as compared to existing methods. The assembly does not require the use of any glue or attachment tabs; the picture frame can, therefore, be repeatedly returned to a planar form and then refolded. The picture frame produced is comparatively strong and aesthetically pleasing.

It is essential that the second edge and the third edge be insertable through the picture viewing window. This can be accomplished in a number of ways. It is preferred that the head portion is trimmed such that the border sections of the second foldable portion and the third foldable portion are angled inwardly from the first fold line and the fourth edge. It is also preferred that the head portion is trimmed such that the retaining flaps of the second foldable portion and the third foldable portion are angled inwardly.

Although beneficial results may be obtained through the use of the method, as described, the relative strength can be increased by having more fold lines positioned parallel to the transverse fold line dividing the interior portions. For example, even more beneficial results may be obtained by having four fold lines parallel to the transverse fold line thereby dividing the interior portions into a thickness section, a retaining flap, a first reinforcing section and a second reinforcing section. The interior foldable portions fold to form parallelepiped reinforcing members.

BRIEF DESCRIPTION OF THE DRAWINGS

These and other features of the invention will become more apparent from the following description in which reference is made to the-appended drawings, wherein.

DETAILED DESCRIPTION OF THE PREFERRED EMBODIMENT

A method of constructing an origami-style of foldable picture frame from a unitary blank of sheet material will now be described with reference to FIGS. 1 through 10.

Figure 1:
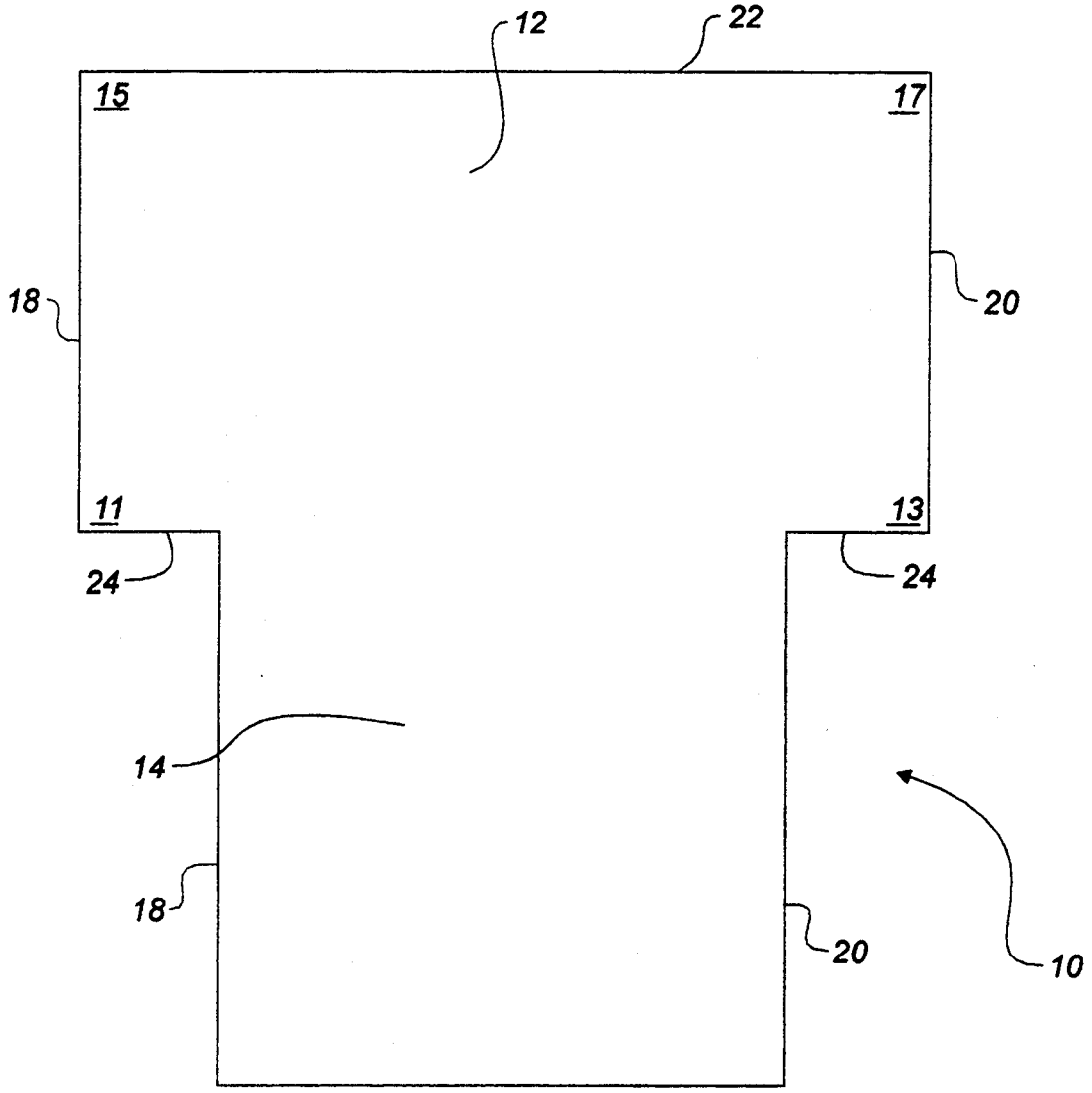
FIG. 1 is a top plan view of a unitary blank which has been cut to an appropriate shape.
Figure 2:
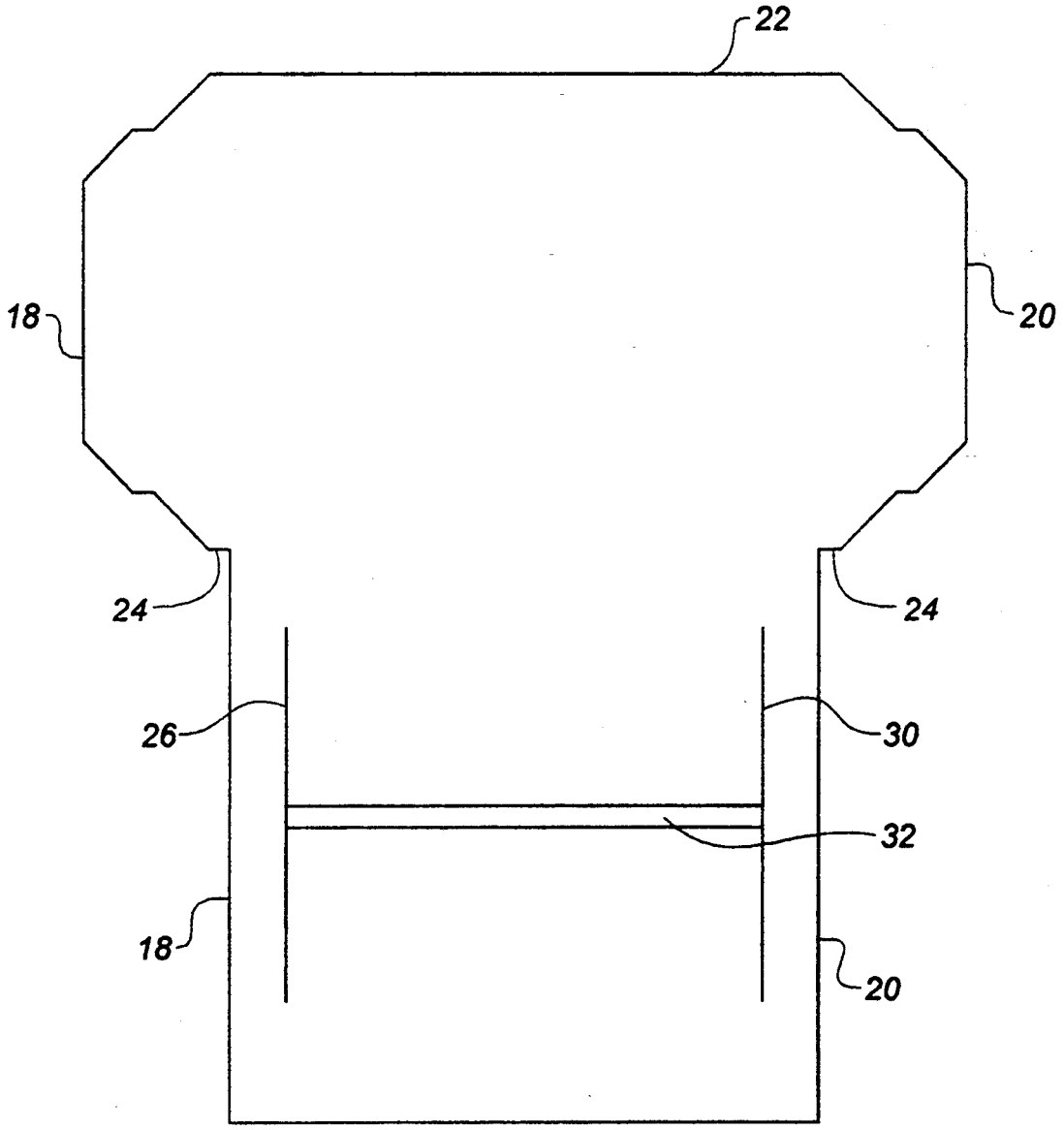
FIG. 2 is a top plan view of the unitary blank illustrated in FIG. 1, with cut lines placed upon it and corners trimmed.
Figure 3:
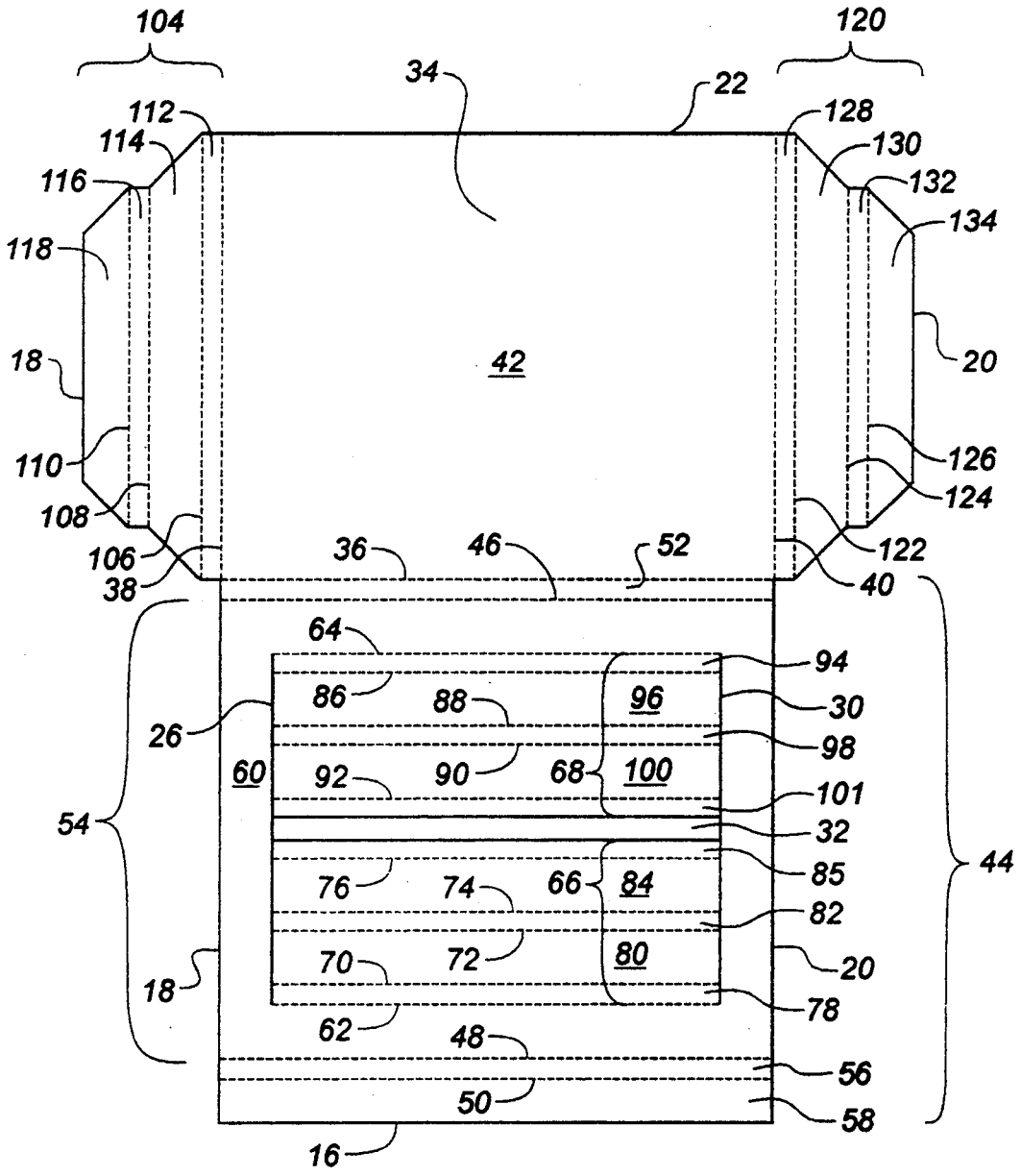
FIG. 3 is a top plan view of the unitary blank illustrated in FIG. 2, with fold lines placed upon it.
Figure 4:
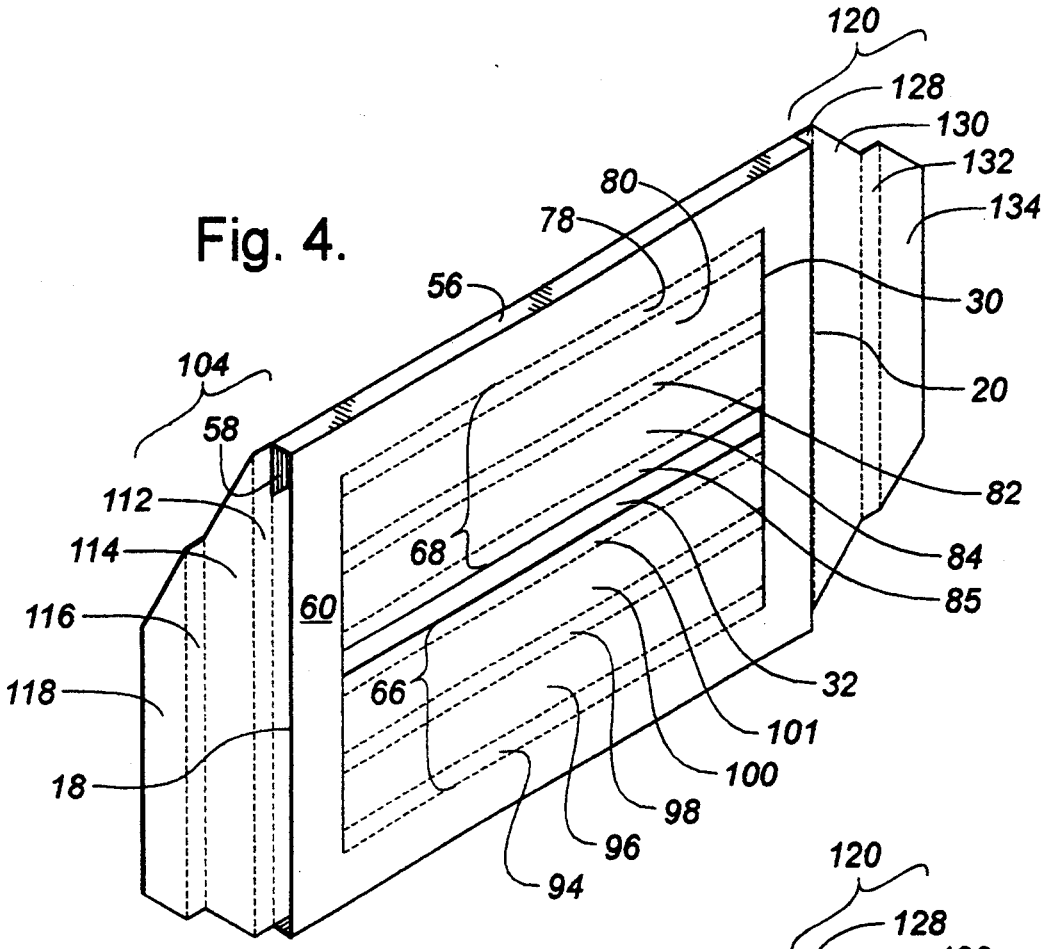
FIG. 4 is a perspective view of a partially completed picture frame made from the unitary blank illustrated in FIG. 3, folded along the fold lines described in the fifth step of the described method.
Figure 5:
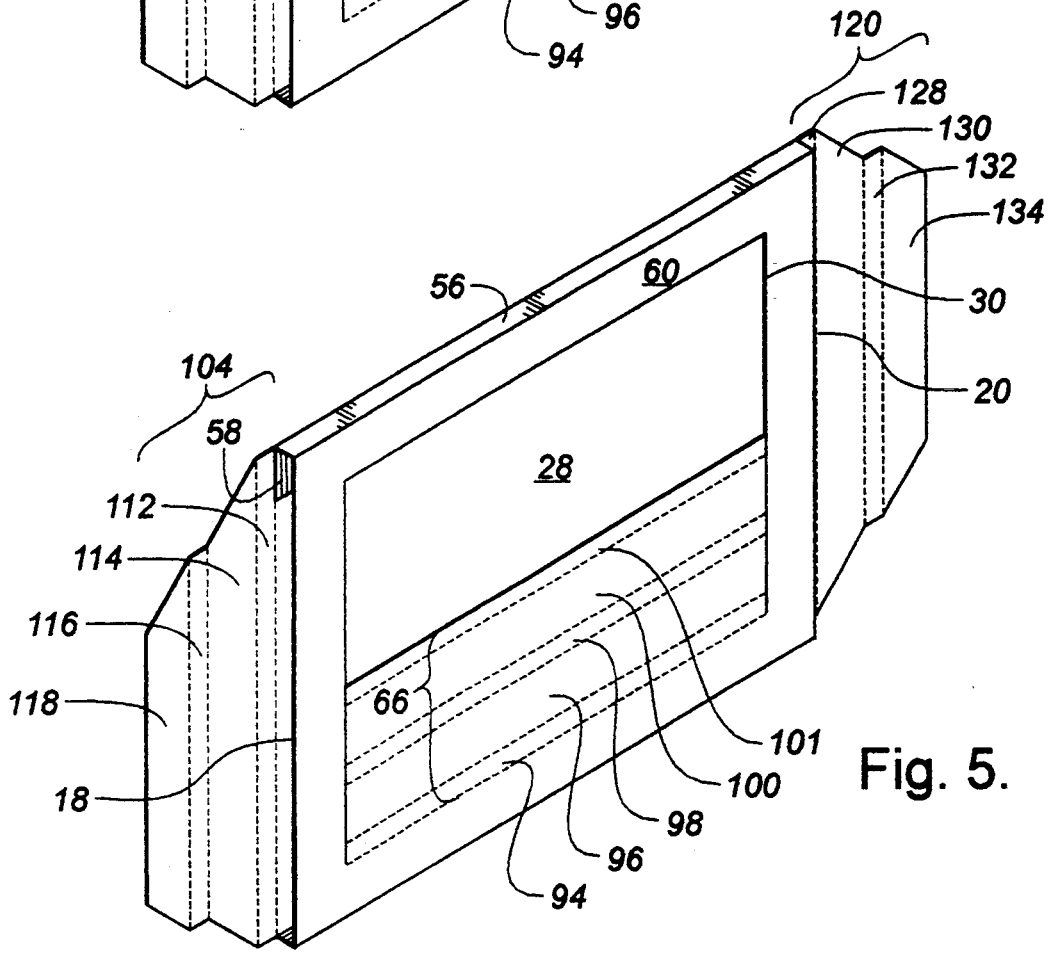
FIG. 5 is a perspective view of the partially completed picture frame illustrated in FIG. 4, partially folded along the fold lines described in the sixth step of the described method.
Figure 6:
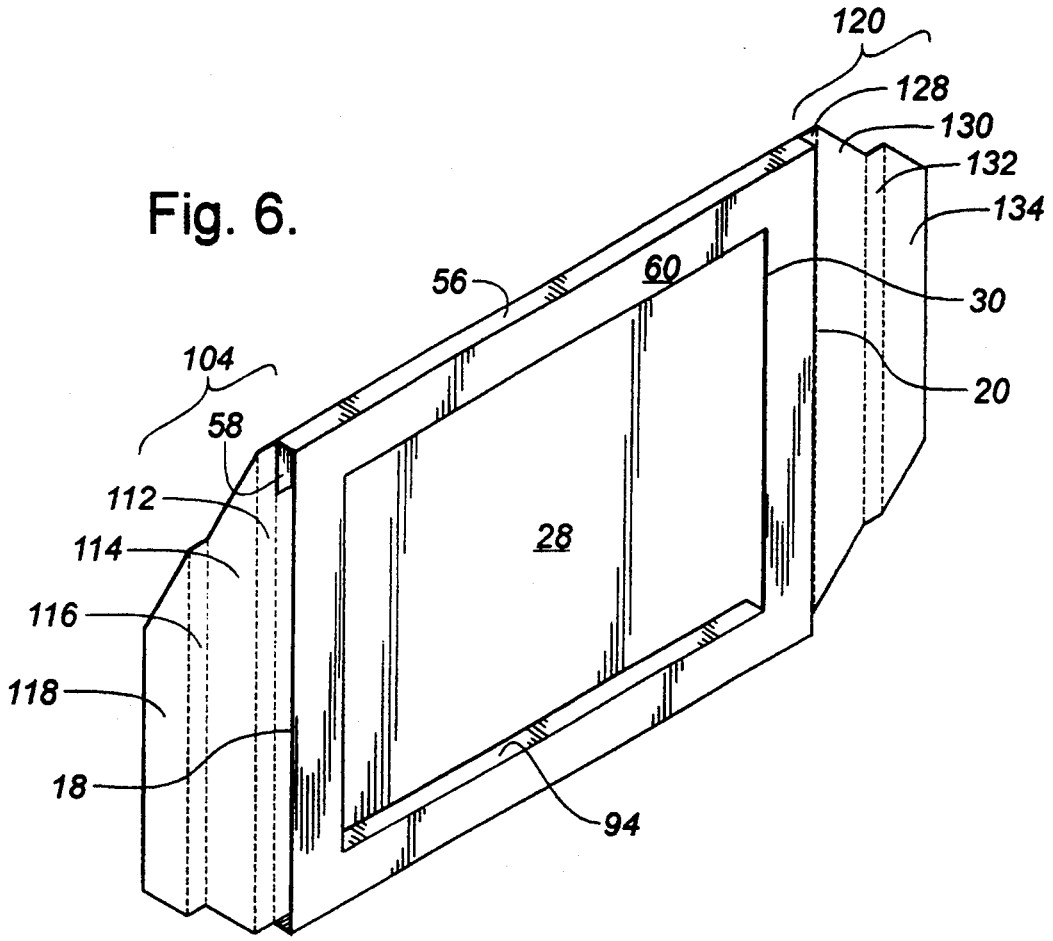
FIG. 6 is a perspective view of the partially completed picture frame illustrated in FIG. 5, completely folded along the fold lines described in the sixth step of the described method.
Figure 7:
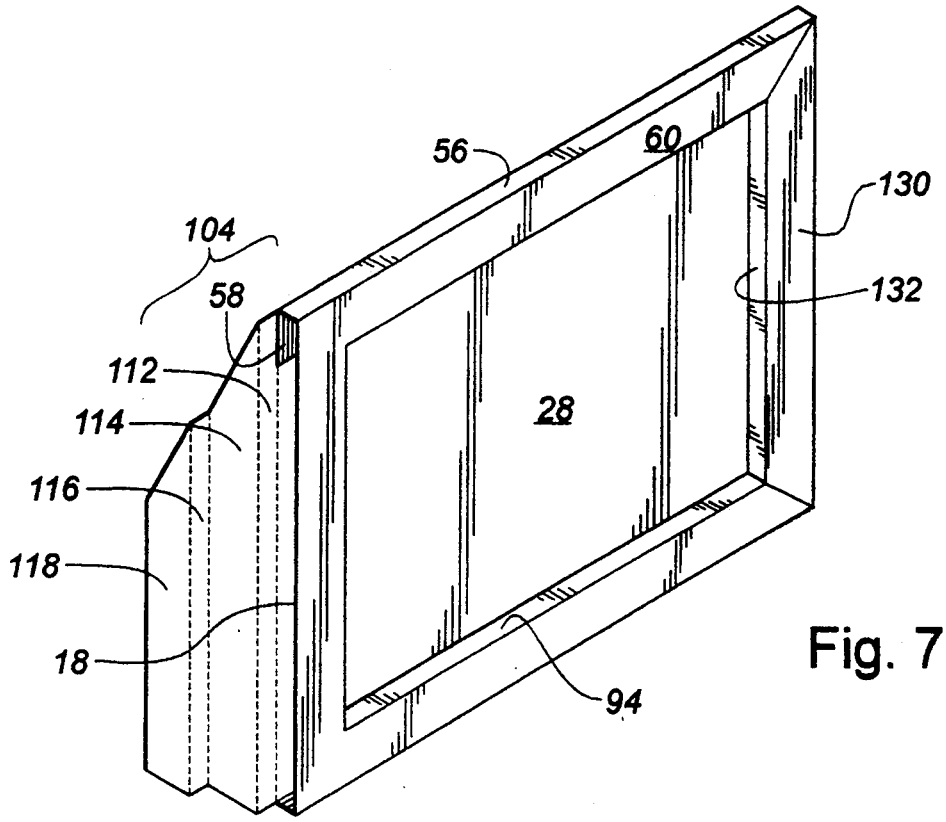
FIG. 7 is a perspective view of the partially completed picture frame illustrated in FIG. 6, folded along the fold lines described in the seventh step of the described method.
Figure 8:
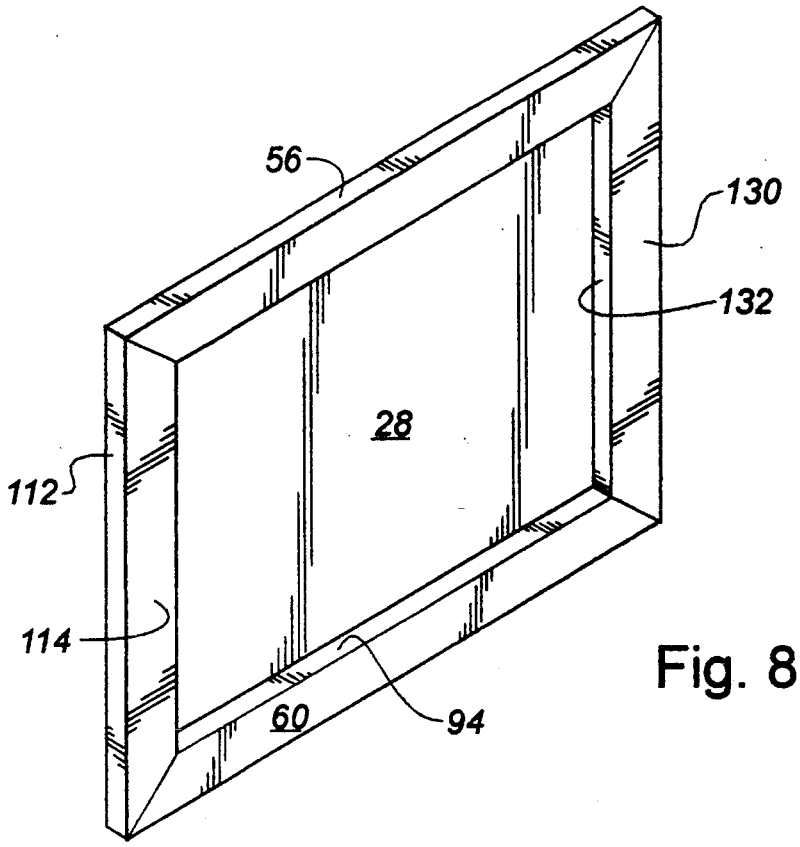
FIG. 8 is a perspective view of a completed picture frame formed out of the partially completed picture frame illustrated in FIG. 7, by folding along the fold lines described in the eighth step of the described method.

The method includes the following steps. Firstly, cut a unitary blank 10 of sheet material to form a substantially rectangular head portion 12 and a substantially rectangular depending neck portion 14, as illustrated in FIG. 1. Unitary blank 10 has a first edge 16, a second edge 18, a third edge 20, a fourth edge 22, and an abbreviated fifth edge 24. First edge 16 defines an extremity of neck portion 14. Fourth edge 22 defines an extremity of head portion 12. Fifth edge 24 is that portion of head portion 12 which extends beyond neck portion 14. Head portion 12 of unitary blank 10 has corners 11, 13, 15, and 17. Corner 11 is formed where fifth edge 24 meets second edge 18. Corner 13 is formed where fifth edge 24 meets third edge 20. Corner 15 is formed where fourth edge 22 meets second edge 18. Corner 17 is formed where fourth edge 22 meets third edge 20. Secondly, place a series of cut lines on unitary blank 10 as is illustrated in FIG. 2. A first cut line 26 is spaced from second edge 18 on neck portion 14 of unitary blank 10. First cut line 26 defines a width dimension for a picture viewing window, generally identified in FIGS. 6, 7, and 8 as reference numeral 28. A second cut line 30 is spaced from third edge 20 of neck portion 14 in parallel spaced relation to first cut line 26. Second cut line 30 is the same length as first cut line 26. The spacing between first cut line 26 and second cut line 30 defines a length dimension for picture viewing window 28. A third cut line 32 extends transversely between first cut line 26 and second cut line 30 in an intermediate position. For clarity third cut line 32 has been enlarged. Thirdly, trim off corners 11, 13, 15, and 17 from head portion 12 of unitary blank 10 as illustrated in FIG. 2. The intent in trimming the corners as described is to ensure that width dimension of second edge 18 and third edge 20 on head portion 12 of unitary blank 10 are less than the length of first cut line 16 and second cut line 30. This enables second edge 18 and third edge 20 of head portion 12 to be adapted for insertion into picture viewing window 28, as will hereinafter be further described. Fourthly, form a substantially rectangular primary panel 34 on head portion 12 as illustrated in FIG. 3. This is accomplished by placing a first fold line 36 spaced from first edge 16, a second fold line 38 spaced from second edge 18, and a third fold line 40 spaced from third edge 20 and opposed to second fold line 38. Fourth edge 22 of unitary blank 10 is opposed to first fold line 36 and completes primary panel 34. Primary panel 34 has a top face 42. Fifthly, form material extending from first fold line 36 to first edge 16 into a first foldable portion 44 as illustrated in FIG. 3. This is accomplished by placing a series of three fold lines 46, 48, and 50 parallel to first fold line 36. Fold lines 46, 48, and 50 divide first foldable portion 44 into a first exterior thickness section 52, a substantially rectangular secondary panel 54, a second exterior thickness section 56, and a retaining flap 58. Secondary panel 54 is substantially the same size as primary panel 34 and is adapted to overlay primary panel 34 as will hereinafter be further described. Secondary panel 54 has a peripheral border 60 defined by first edge 16, second edge 18, third edge 30, fold line 46, first cut line 26, second cut line 30, a first transverse fold line 62 spaced from first edge 16 and extending between first cut line 26 and second cut line 30, and a second transverse fold line 64 extending between first cut line 26 and second cut line 30 opposed to first transverse fold line 30. Sixthly, form material extending inwardly from first transverse fold line 62 to third cut line 32 and second transverse fold 64 line to third cut line 32 into interior foldable portions 66 and 68, respectively, as illustrated in FIG. 3. This is accomplished by placing a series of four fold lines 70, 72, 74 and 76 parallel to first transverse fold line 62 thereby dividing interior foldable portion 66 into a thickness section 78, a retaining flap 80, a first reinforcing section 82, a second reinforcing section 84, and a third reinforcing section 85. A series of four fold lines 86, 88, 90, and 92 are placed parallel to second transverse fold line 64 thereby dividing interior foldable portion 68 into a thickness section 94, a retaining flap 96, a first reinforcing section 98, a second reinforcing section 100, and a third reinforcing section 101. Interior foldable portions 66 and 68 fold to form parallelepiped reinforcing members 102, such as illustrated in and further described with reference to FIG. 9. Seventhly, form material extending from second fold line 38 on head portion 12 to second edge 18 into a second foldable portion 104 as illustrated in FIG. 3. This is accomplished by placing a series of three fold lines 106, 108, and 110 parallel to second fold line 38 thereby dividing second foldable portion 104 into an exterior thickness section 112, a border section 114, an interior thickness section 116, and a retaining flap 118. Eighthly, form material extending from third fold line 40 to third edge 20 into a third foldable portion 120 as illustrated in FIG. 3. This is accomplished by placing a series of three fold lines 122, 124, 126 parallel to third fold line 40 thereby dividing third foldable portion 120 into an exterior thickness section 128, a border section 130, an interior thickness section 132, and retaining flap 134. Thickness sections 52, 56, 112, 116, 128, 132 of each of foldable portions 44, 104 and 120 are of uniform dimension. Similarly, border sections 60, 114 and 130 of each of foldable portions 44, 104, 120 are of uniform dimension. Ninthly, fold unitary blank 10 to form a picture frame by making the following described folds. The described folds are illustrated in sequence in FIGS. 4 through 8. Referring to FIG. 4, first foldable portion 44 is folded with secondary panel 54 overlying front face 42 of primary panel 34. When in this position, retaining flap 58 rests parallel to front face 42 of primary panel 34. Thickness sections 52 and 56 defined a thickness dimension. Referring to FIG. 5, interior foldable portion 66 is folded such that retaining flap 80 rests parallel to front face 42 of primary panel 34. In this position, thickness section 78 defines a thickness dimension, and the remaining sections 82, 84, 85 provide strengthening reinforcement as will hereinafter be described with reference to FIG. 9. Referring to FIG. 6, interior foldable portion 68 is folded such that retaining flap 96 rests parallel to front face 42 of primary panel 34. In this position, thickness section 94 defines a thickness dimension and the remaining sections 98, 100, and 101 provide thickening reinforcement as will hereinafter be further described. Referring to FIG. 7, third foldable portion is folded such that interior thickness section 132 and retaining flap section 134 extend through picture viewing window 28. Retaining flap section 134 is inserted between secondary panel 54 of first foldable portion 44 and front face 42 of primary panel 34, as is illustrated and hereinafter further described with respect to FIG. 10. Exterior thickness section 128 defines an exterior thickness dimension and border section 130 overlies border 60 of secondary panel 54. Referring to FIG. 8, second foldable portion is folded such that interior thickness section 116 and retaining flap section 118 extend through picture viewing window 28. Retaining flap section 118 is inserted between secondary panel 54 of first foldable section 134 and front face 42 of primary panel 34.

Figure 9:
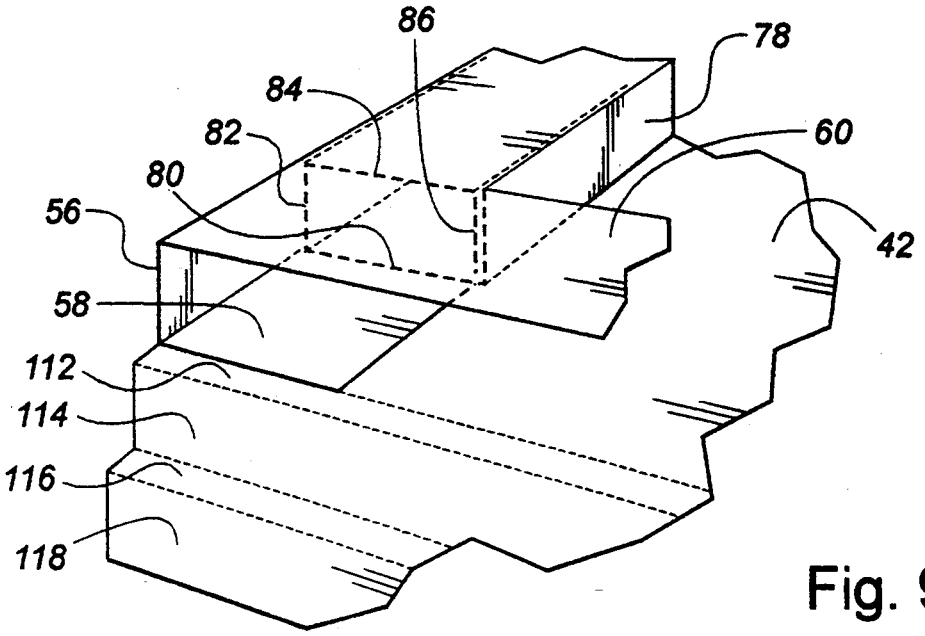
FIG. 9 is a detailed perspective view of a parallelepiped reinforcing member.
Figure 10:
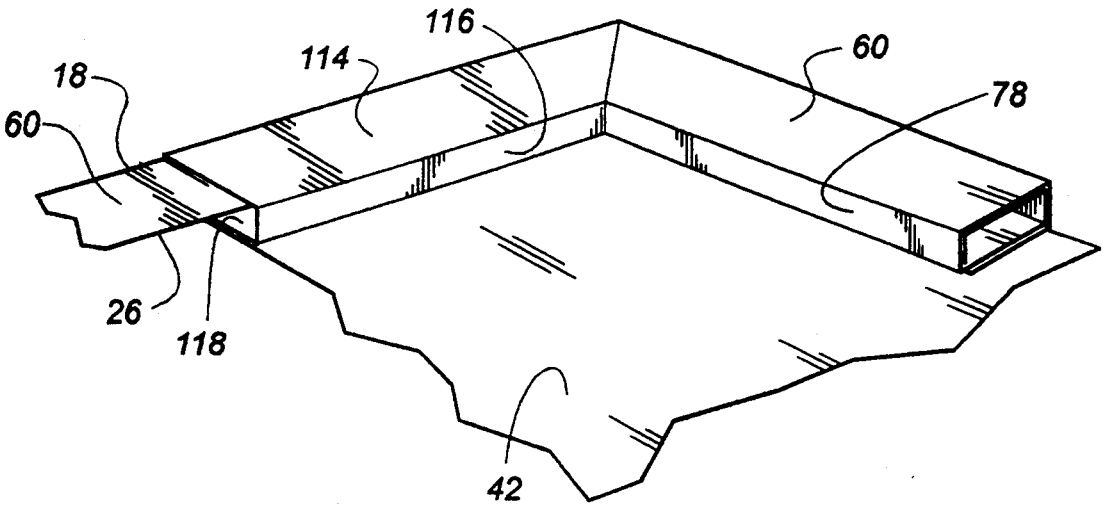
FIG. 10 is a detailed cut-away view of the completed picture frame illustrated in FIG. 8.

It is to be noted that assembly does not require the use of any glue or attachment tabs. This is made possible by a the use of overlying secondary panel 54 in combination with second foldable portion 104 and third foldable portion 120 which are insertable through picture viewing opening 28 and wrap around secondary panel 54 of first foldable section 44. Second foldable portion 104 and third foldable portion 120 have retaining flap sections 118 and 134, respectively, that tuck under secondary panel 54 of first foldable section 44 to maintain the picture frame in an assembled condition. This assembly is illustrated in FIG. 10. The picture frame produced by this method is comparatively strong and aesthetically pleasing. The improved aesthetics comes from the mode of construction utilizing secondary panel 54. Prior art frames are prone to separation at corner seams. With the method, as described there are no corner seams. The only "seam" visible on a frontal view is where border sections 114 and 130 of second foldable portion 104 and third foldable portion 120, respectively, overly borer 60 of secondary panel 54. These "seams" are unlikely to separate as second foldable portion 104 and third foldable portion 120 are held in place by the positioning of their respective retaining flaps 118 and 134. The improved strength comes in part from parallelepiped reinforcing member 102 which is formed when interior foldable sections 66 and 68 are folded. This parallelepiped reinforcing member is illustrated in FIG. 9.

Referring to FIG. 3, there is illustrated a preferred way of trimming corners 11, 13, 15, and 17 from unitary blank 10. This trimming takes into consideration the folds that are to subsequently be made in unitary blank 10. Border sections 114 and 130 of second foldable portion 104 and third foldable portion 120, respectively are angled inwardly from fifth fold line 24 and fourth edge 22. Retaining flaps 118 and 134 of second foldable portion 104 and third foldable portion 120, respectively, are angled inwardly. Interior thickness sections 116 and 132 of second foldable portion 104 and third foldable portion 120, respectively, are cut substantially parallel to fourth edge 22.

According to another aspect of the invention, there is an origami-style of foldable picture frame constructed from a unitary blank. A preferred embodiment of this foldable picture frame in the form in which it is sold to the public is illustrated in FIG. 3, as has been described. It will be apparent to one skilled in the art that modifications may be made to the illustrated embodiment without departing from the spirit and scope of the invention as defined by the Claims. In particular, the manner of trimming of corners 11, 13, 15, and 17 can differ as long as second edge 18 and third edge 20 are trimmed sufficiently to allow second foldable portion 104 and third foldable portion 120 to be wrapped around secondary panel 54, inserted through picture viewing window 28 and tucked into place to hold the picture frame in an assembled condition. The configuration of interior foldable portions 66 and 68, and, in particular, the amount of reinforcement can, similarly, be varied.

THE EMBODIMENTS OF THE INVENTION IN WHICH AN EXCLUSIVE PROPERTY OR PRIVILEGE IS CLAIMED ARE AS FOLLOWS:

1. A method of constructing an origami-style of foldable picture frame from a unitary blank of sheet material, comprising the steps of:

a. firstly, cutting a unitary blank of sheet material to form a substantially rectangular head portion and a substantially rectangular depending neck portion, the unitary blank having a first edge, a second edge, a third edge, a fourth edge, and an abbreviated fifth edge, the first edge defining an extremity of the neck portion, the fourth edge defining an extremity of the head portion, the fifth edge being that portion of the head portion which extends beyond the neck portion;

b. secondly, placing a first cut line spaced from the second edge on the neck portion of the unitary blank defining a desired width for a picture viewing window, a second cut line spaced from the third edge of the neck portion in parallel spaced relation to the first cut line, the second cut line being the same length as the first cut line and the spacing between the first cut line and the second cut line defining a desired length for the picture viewing window, and a third cut line extending transversely between the first cut line and the second cut line in an intermediate position;

c. thirdly, trimming off corners formed on the head portion of the unitary blank where the fifth edge meets the second edge and the third edge and where the fourth edge meets the second edge and the third edge, such that the width dimension of the second edge and the third edge are less than the length of the first cut line and the second cut line such that the second edge and the third edge of the head portion are adapted for insertion into the picture viewing window;

d. fourthly, forming a substantially rectangular primary panel on the head portion by placing a first fold line spaced from the first edge, a second fold line spaced from the second edge, a third fold line spaced from the third edge and opposed to the second fold line, such that the fourth edge of the unitary blank is opposed to the first fold line and completes the primary panel, the primary panel having a top face;

e. fifthly, forming material extending from the first fold line to the first edge into a first foldable portion by placing a series of three fold lines parallel to the first fold line dividing the first portion into a first exterior thickness section, a substantially rectangular secondary panel substantially the same size as the primary panel and adapted to overlay the primary panel, a second exterior thickness section, and a retaining flap, the secondary panel having peripheral border sections defined by the cut lines for the picture viewing window and a first transverse fold line spaced from the first edge and extending between the first cut line and the second cut line, and a second transverse fold line extending between the first cut line and the second cut line opposed to the first transverse fold line;

f. sixthly, forming material extending inwardly from the first transverse fold line to the third cut line and the second transverse fold line to the third cut line into interior foldable portions by placing a series of at least two fold lines parallel to the transverse fold line dividing the interior portions into a thickness section and a retaining flap;

g. seventhly, forming material extending from the second fold line to the second edge into a second foldable portion by placing a series of three fold lines parallel to the second fold line dividing the second portion into an exterior thickness section, a border section, an interior thickness section, and retaining flap;

h. eighthly, forming material extending from the third fold line to the third edge into a third foldable portion by placing a series of three fold lines parallel to the third fold line dividing the third portion into an exterior thickness section, a border section, an interior thickness section, and retaining flap, the thickness sections of each of the foldable portions being of uniform dimension, the border sections of each of the foldable portions being of uniform dimension; and i. ninthly, folding the unitary blank of sheet material to form a picture frame by folding the first foldable portion such that the secondary panel overlies the front face of the primary panel with the retaining flap resting parallel to the primary panel, folding the interior foldable portions such that the retaining flap rests parallel to the primary panel, folding the second foldable portion such that the interior thickness section and the retaining flap section extend through the picture viewing window with the retaining flap section inserted between the secondary panel and the primary panel, and folding the third foldable portion such that the interior thickness section and the retaining flap section extend through the picture viewing window with the retaining flap section inserted between the secondary panel and the primary panel.

2. The method as defined in claim 1, the head portion being trimmed such that the border sections of the second foldable portion and the third foldable portion are angled inwardly from the fifth fold line and the fourth edge.

3. The method as defined in claim 1, the head portion being trimmed such that the retaining flaps of the second foldable portion and the third foldable portion are angled inwardly.

4. The method as defined in claim 1, having four fold lines parallel to the transverse fold line dividing the interior portions into a thickness section, a retaining flap, a first reinforcing section, a second reinforcing section and a third reinforcing section, such that the interior foldable portions fold to form parallelepiped reinforcing members.

5. An origami-style of foldable picture frame constructed from a unitary blank, comprising:

a. a unitary blank of sheet material having a substantially rectangular head portion, a substantially rectangular depending neck portion, a first edge, a second edge, a third edge, a fourth edge, and an abbreviated fifth edge, the first edge defining an extremity of the neck portion, the fourth edge defining an extremity of the head portion, the fifth edge being that portion of the head portion which extends beyond the neck portion;

b. a first cut line spaced from the second edge on the neck portion of the unitary blank defining a desired width for a picture viewing window, a second cut line spaced from the third edge of the neck portion in parallel spaced relation to the first cut line, the second cut line being the same length as the first cut line-and the spacing between the first cut line and the second cut line defining a desired length for the picture viewing window, and a third cut line extending transversely between the first cut line and the second cut line in an intermediate position, the width dimension of the second edge and the third edge are less than the length of the first cut line and the second cut line such that the second edge and the third edge of the head portion are adapted for insertion into the picture viewing window;

c. a substantially rectangular primary panel on the head portion defined by a first fold line spaced from the first edge, a second fold line spaced from the second edge, a third fold line spaced from the third edge and opposed to the second fold line, such that the fourth edge of the unitary blank is opposed to the first fold line and completes the primary panel, the primary panel having a top face;

d. a first foldable portion between the first fold line and the first edge consisting of three fold lines parallel to the first fold line dividing the first foldable portion into a first exterior thickness section, a substantially rectangular secondary panel substantially the same size as the primary panel and adapted to overlay the primary panel, a second exterior thickness section, and a retaining flap, the secondary panel having peripheral border sections defined by the cut lines for the picture viewing window and a first transverse fold line spaced from the first edge and extending between the first cut line and the second cut line, and a second transverse fold line extending between the first cut line and the second cut line opposed to the first transverse fold line;

e. interior foldable portions between the first transverse fold line and the third cut line and between the second transverse fold line and the third cut line, including at least two fold lines parallel to the transverse fold line dividing the interior portions into a thickness section and a retaining flap;

f. a second foldable portion between the second fold line and the second edge, including a series of three fold lines parallel to the second fold line dividing the second portion into an exterior thickness section, a border section, an interior thickness section, and retaining flap; and g. a third foldable portion between the third fold line and the third edge, including a series of three fold lines parallel to the third fold line dividing the third portion into an exterior thickness section, a border section, an interior thickness section, and retaining flap, the thickness sections of each of the foldable portions being of uniform dimension, the border sections of each of the foldable portions being of uniform dimension.

6. The origami-style foldable picture frame as defined in claim 5, the head portion being trimmed such that the border sections of the second foldable portion and the third foldable portion are angled inwardly from the fifth fold line and the fourth edge.

7. The origami-style foldable picture frame as defined in claim 5, the head portion being trimmed such that the retaining flaps of the second foldable portion and the third foldable portion are angled inwardly.

8. The origami-style foldable picture frame as defined in claim 5, having four fold lines parallel to the transverse fold line dividing the interior portions into a thickness section, a retaining flap, a first reinforcing section, a second reinforcing section and a third reinforcing section, such that the interior foldable portions fold to form parallelepiped reinforcing members.

* * * * *

UNITED STATES PATENT AND TRADEMARK OFFICE

CERTIFICATE OF CORRECTION

PATENT NO. : 5,365,684

DATED : November 22, 1994

INVENTOR(S) : Brian Cartmell and Sylvain Voyer

It is certified that error appears in the above-indentified patent and that said Letters Patent is hereby corrected as shown below: On title page, item

(76) Inventors: Brian Cartmell, 10338-139 Street
Edmonton, Alberta, Canada, T5N
2H2
Sylvain Voyer, 10904-75 Street
Edmonton, Alberta, Canada, T5B
2B3

Signed and Sealed this

Twenty-fourth Day of June, 1997

Bruce Lehman

*Attest:*

BRUCE LEHMAN

*Attesting Officer*

*Commissioner of Patents and Trademarks*